US007281819B2

(12) United States Patent
Hsieh et al.

(10) Patent No.: US 7,281,819 B2
(45) Date of Patent: Oct. 16, 2007

(54) LED TRAFFIC LIGHT STRUCTURE

(75) Inventors: Chi-Tang Hsieh, Chung Ho (TW); Po-Laung Huang, Chung Ho (TW); Chan-Ching Lin, Chung Ho (TW)

(73) Assignee: Chip Hope Co., Ltd., Taipei Hsien (TW)

( * ) Notice: Subject to any disclaimer, the term of this patent is extended or adjusted under 35 U.S.C. 154(b) by 30 days.

(21) Appl. No.: 11/258,537

(22) Filed: Oct. 25, 2005

(65) Prior Publication Data

US 2007/0091601 A1 Apr. 26, 2007

(51) Int. Cl.
*G08B 5/22* (2006.01)

(52) U.S. Cl. ..... 362/244; 362/268; 340/815.45

(58) Field of Classification Search ..... 362/244; 340/907, 815.45

See application file for complete search history.

(56) References Cited

U.S. PATENT DOCUMENTS 5,833,355 A * 11/1998 You et al. ..... 362/244
6,509,840 B2 * 1/2003 Martineau ..... 340/815.45
6,599,002 B2 * 7/2003 Hsieh et al. ..... 362/555
6,717,526 B2 * 4/2004 Martineau et al. ..... 340/815.45
6,731,222 B2 * 5/2004 Martineau ..... 340/815.45
6,955,449 B2 * 10/2005 Martineau ..... 362/246

* cited by examiner

*Primary Examiner*—Hargobind S. Sawhney

(57) ABSTRACT

A traffic light structure includes an LED light source having a circuit board and multiple LEDs securely mounted on the circuit board, a front cover having a first incidence surface provided with multiple lenses each with rectangular lenses and a first emergence surface and an inner cover sandwiched between the front cover and the LED light source and having a second incidence surface and a second emergence surface provided with columns symmetrically arranged relative to a central axis on the second emergence surface. Light of the LEDs scattered and reflected by the inner cover and the front cover is inclined downward to a horizontal axis of the front cover.

15 Claims, 16 Drawing Sheets

LED TRAFFIC LIGHT STRUCTURE

BACKGROUND OF THE INVENTION

1. Field of the Invention

The present invention relates to a traffic light, and more particularly to an LED traffic light structure having a front cover and an inner cover provided with multiple columns symmetrically arranged relative to a central axis on an emergence surface of the inner cover so as to eliminate color difference.

2. Description of Related Art

Because of its high intensity, low energy consumption and low heat generating rate, the light emitting diode (LED) has become more and more popular in all fields. When the LED is used in an indicator or a warning light, the light from the LED has to be scattered so that observers from different directions are able to see the scattered light. A conventional LED traffic light assembly is shown in FIGS. 1 and 2. The conventional LED traffic light assembly has a light casing 10 composed of an incidence surface 11 and an emergence surface 12. The incidence surface 11 has multiple columns 13 integrally formed together with each other and each column 13 is composed of an arcuate surface 131, a flat surface 132, a circular surface 133 and a vertical surface 134. The circular surface 133 is composed of multiple pillars 1331. The positions of the columns 13 correspond to positions of respectively LEDs 20 such that light from the LEDs 20 penetrates through the incidence surface 11 of the light casing 10 and comes out of the emergence surface 12. Due to reflection by different portions of the column 13, the light from the LEDs 20 is able to be focused to observers passing by the traffic light. Although this conventional traffic light assembly is able to focus light to observers, bright zones 21 and dark zones 22 are alternately formed after reflection. Still, each of the LEDs 20 after reflection can still be identified clearly. The conventional construction is not able to combine all the light from respective LEDs 20 so as to form a single light source and to enhance visibility.

To overcome the aforementioned disadvantages, the present invention tends to provide an improved LED traffic light structure.

SUMMARY OF THE INVENTION

In order to accomplish the above objective, the traffic light structure of the present invention has multiple columns symmetrically formed relative to a central axis of the inner cover such that light from the LEDs is able to be combined after reflection.

In one aspect of the present invention, the LED traffic light structure of the present invention has a front cover, an inner cover and an LED light source composed of a circuit board and multiple LEDs securely mounted on the circuit board. The front cover has an incidence surface and an emergence surface. The inner cover also has an incidence surface and an emergence surface. Multiple columns are securely arranged on the emergence surface of the inner cover to substantially form a U or a V shape.

In a different aspect of the present invention, the columns on the emergence surface of the inner cover are so arranged that concentric circles are formed on the emergence surface of the inner cover.

Other objects, advantages and novel features of the invention will become more apparent from the following detailed description when taken in conjunction with the accompanying drawings.

DETAILED DESCRIPTION OF PREFERRED EMBODIMENT

Figure 1:
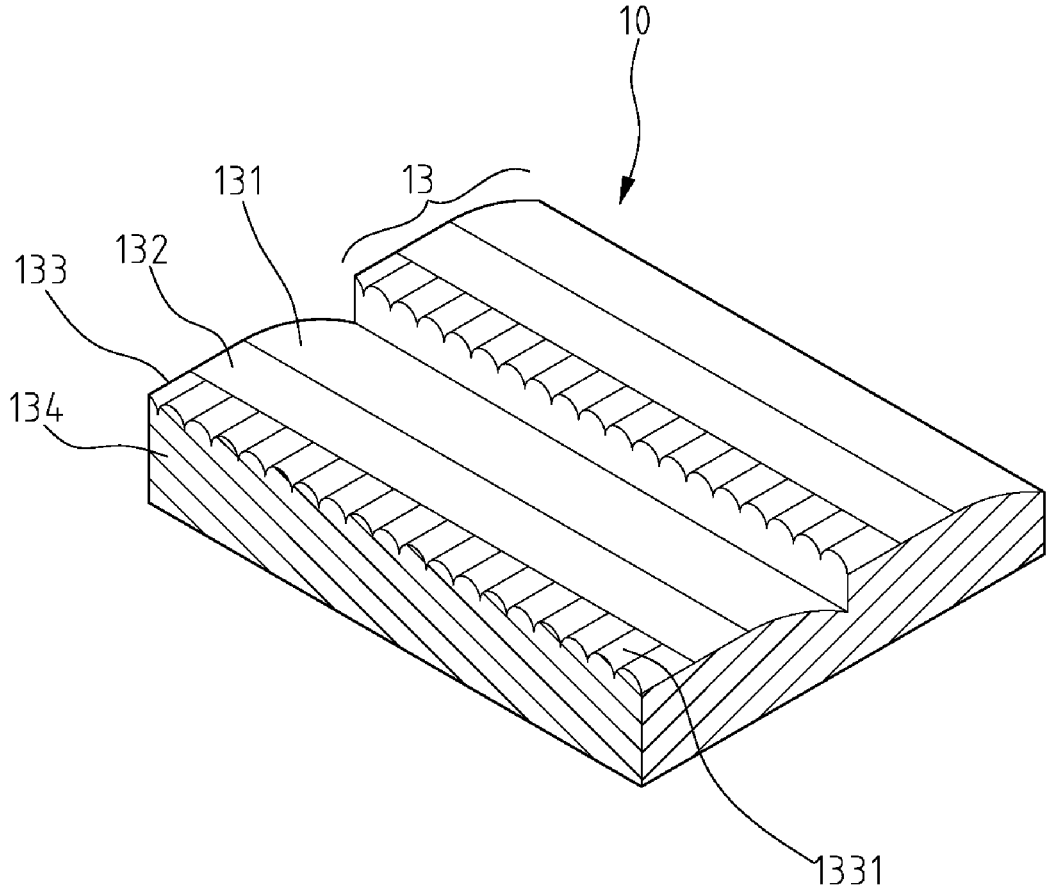
FIG. 1 (Prior Art)
FIG. 1 is a schematic cross sectional view of the conventional traffic light casing.
Figure 2:
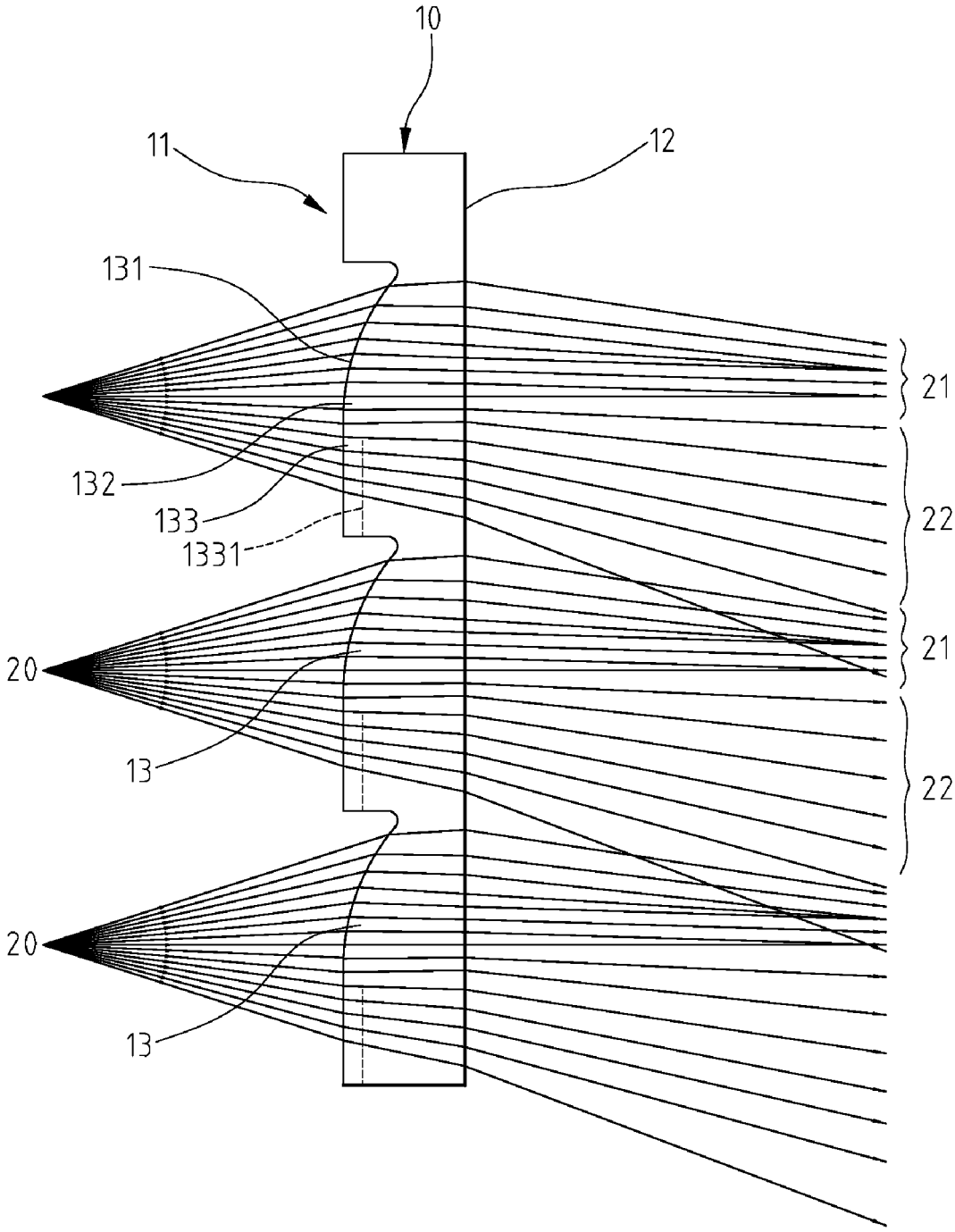
FIG. 2 (Prior Art)
FIG. 2 is a schematic view showing light path penetrating through the light casing from respective LEDs.
Figure 3:
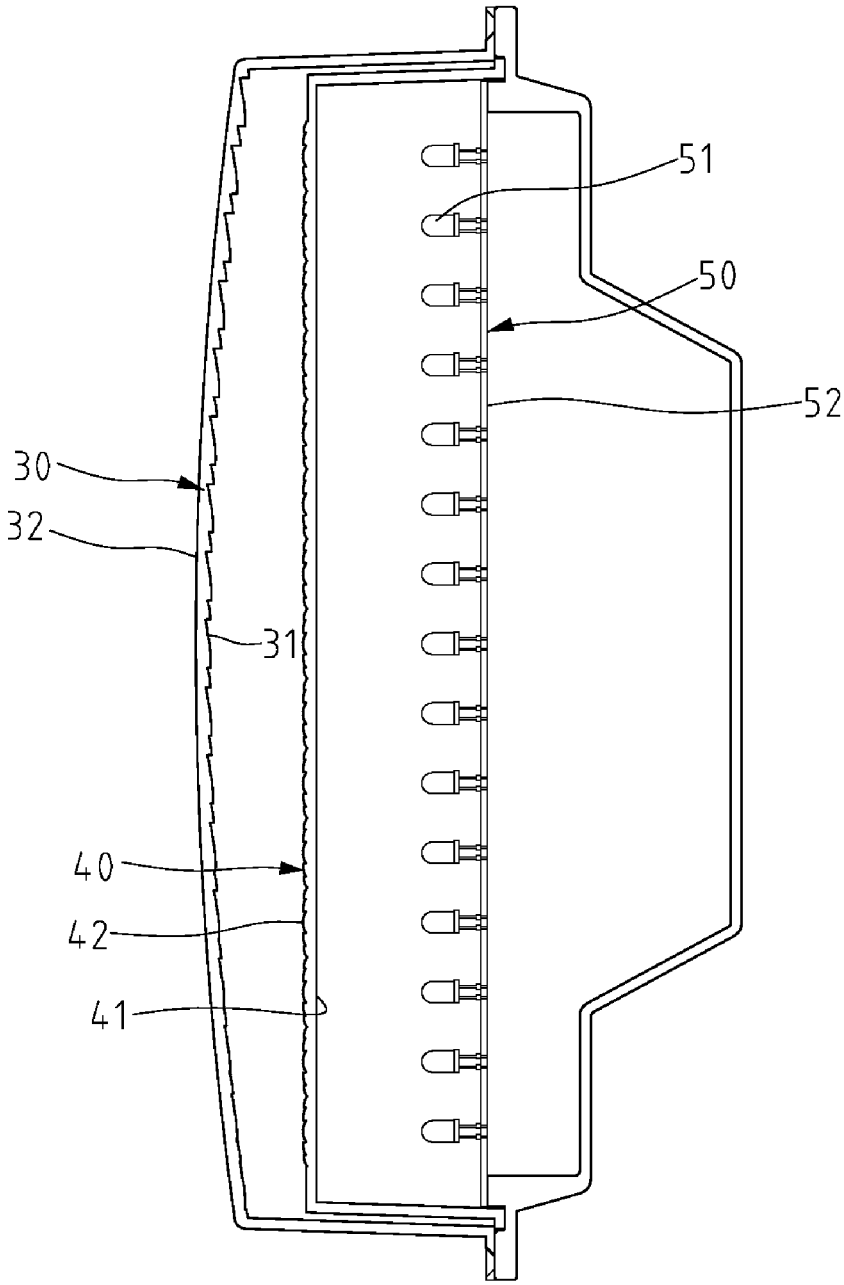
FIG. 3 is a schematic side plan view showing the structure of the LED traffic light of the present invention.

With reference to FIG. 3, it is noted that the LED traffic light structure of the present invention includes a front cover 30 having a first incidence surface 31 and a first emergence surface 32, an LED light source 50 composed of a circuit board 52 and LEDs 51 securely mounted on the circuit board 52 and an inner cover 40 sandwiched between the front cover 30 and the LED light source 50 and having a second incidence surface 41 and a second emergence surface 42.

Figure 4:
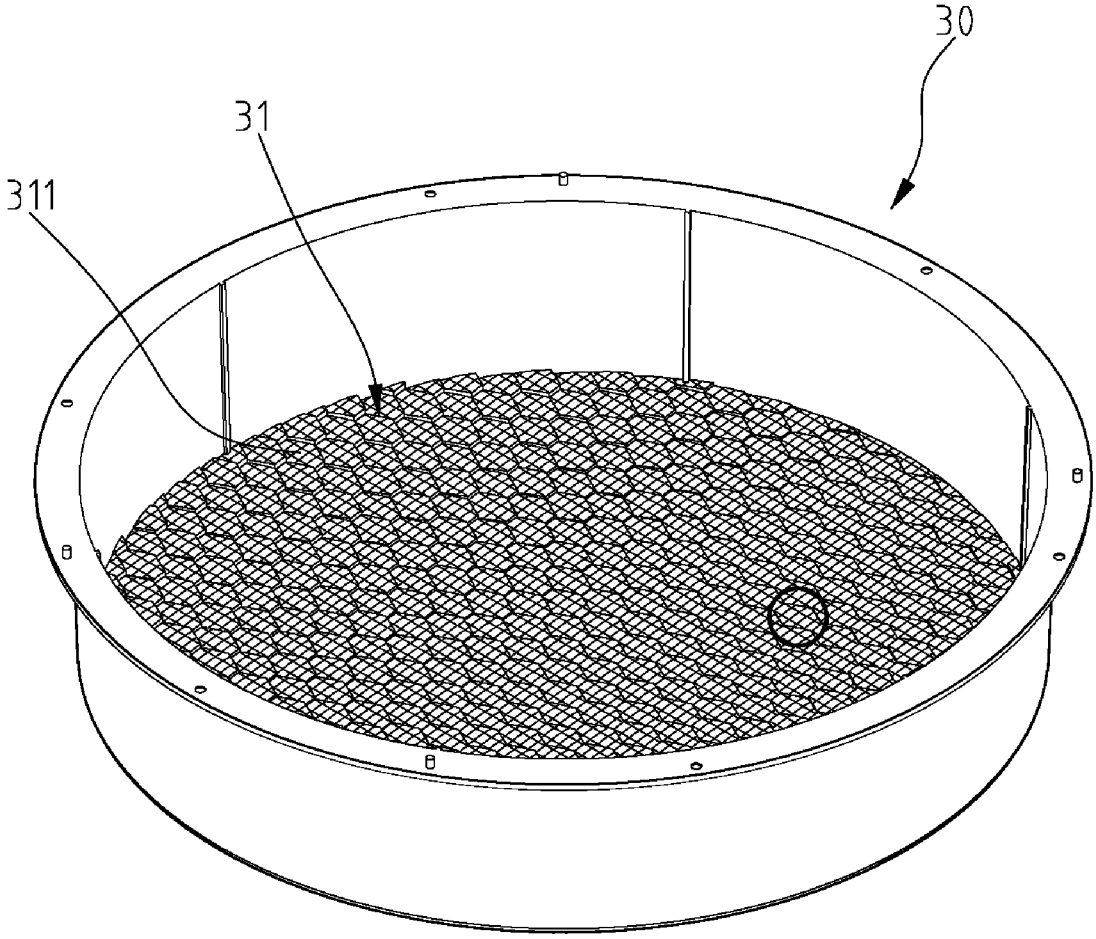
FIG. 4 is a perspective view of the front cover of the present invention.
Figure 5:
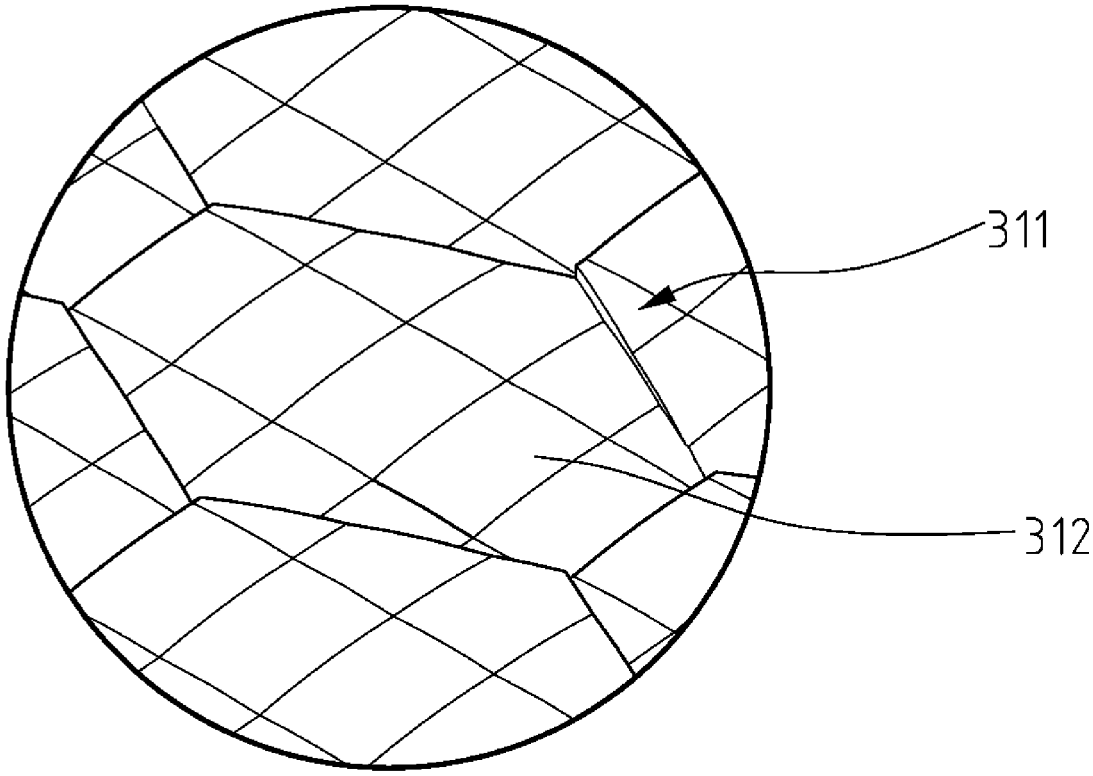
FIG. 5 is a schematic top plan view showing the composition of the incidence surface.
Figure 6:
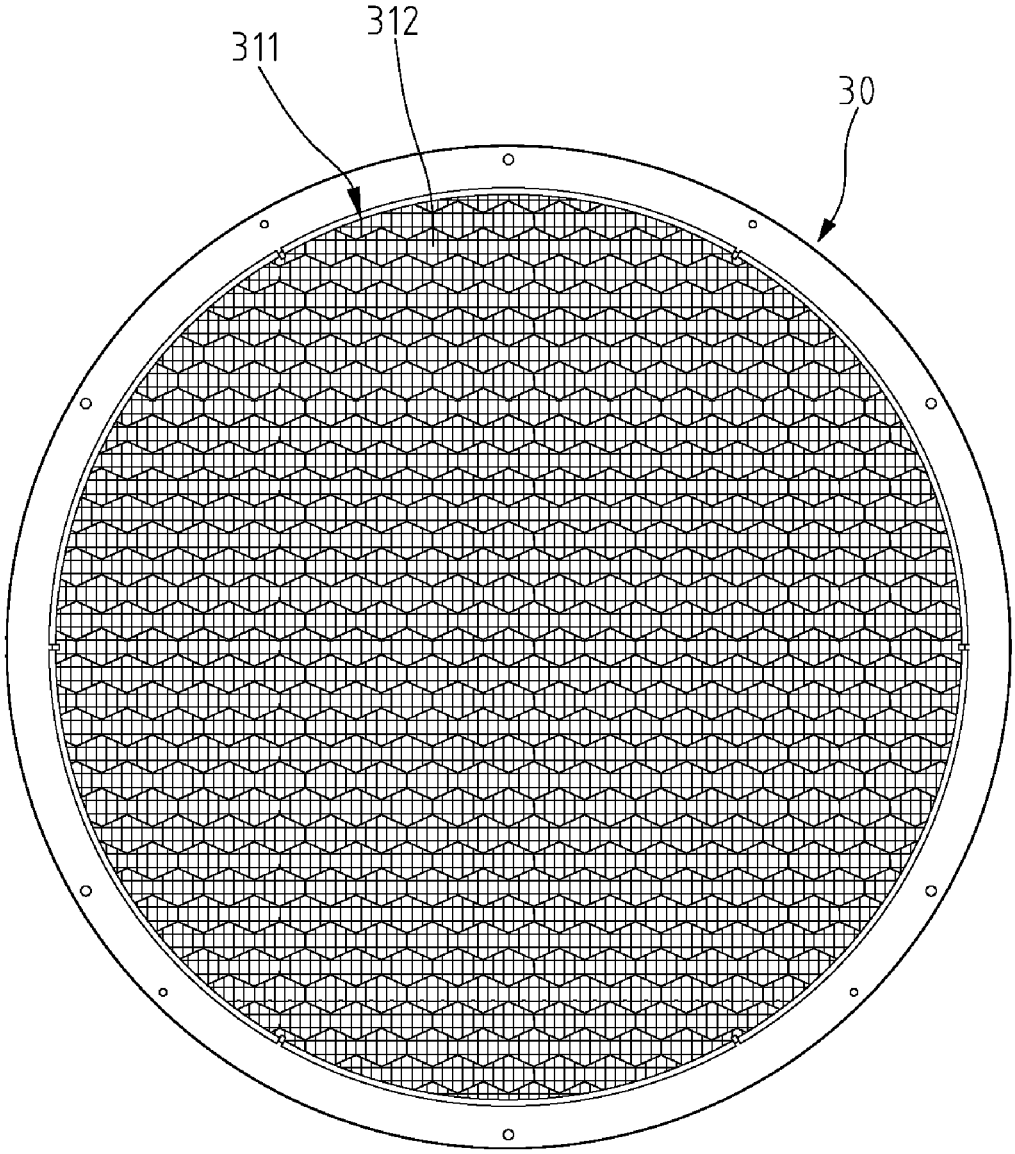
FIG. 6 is a schematic view showing rectangular lenses are provided on the incidence surface of the front cover.

With reference to FIGS. 4 to 6, it is noted that the first incidence surface 31 of the front cover 30 has multiple hexagonal lenses 311 arranged closely with one another to form as a beehive. The shape of the lenses 311 is not limited to hexagon. Other shapes such as rectangle, square, circular or the combination thereof may also be formed. Each hexagonal lens 311 may be composed of multiple rectangular lenses 312. The first emergence surface 32 is a plan surface and may be formed as a concave lens or a convex lens.

Figure 7:
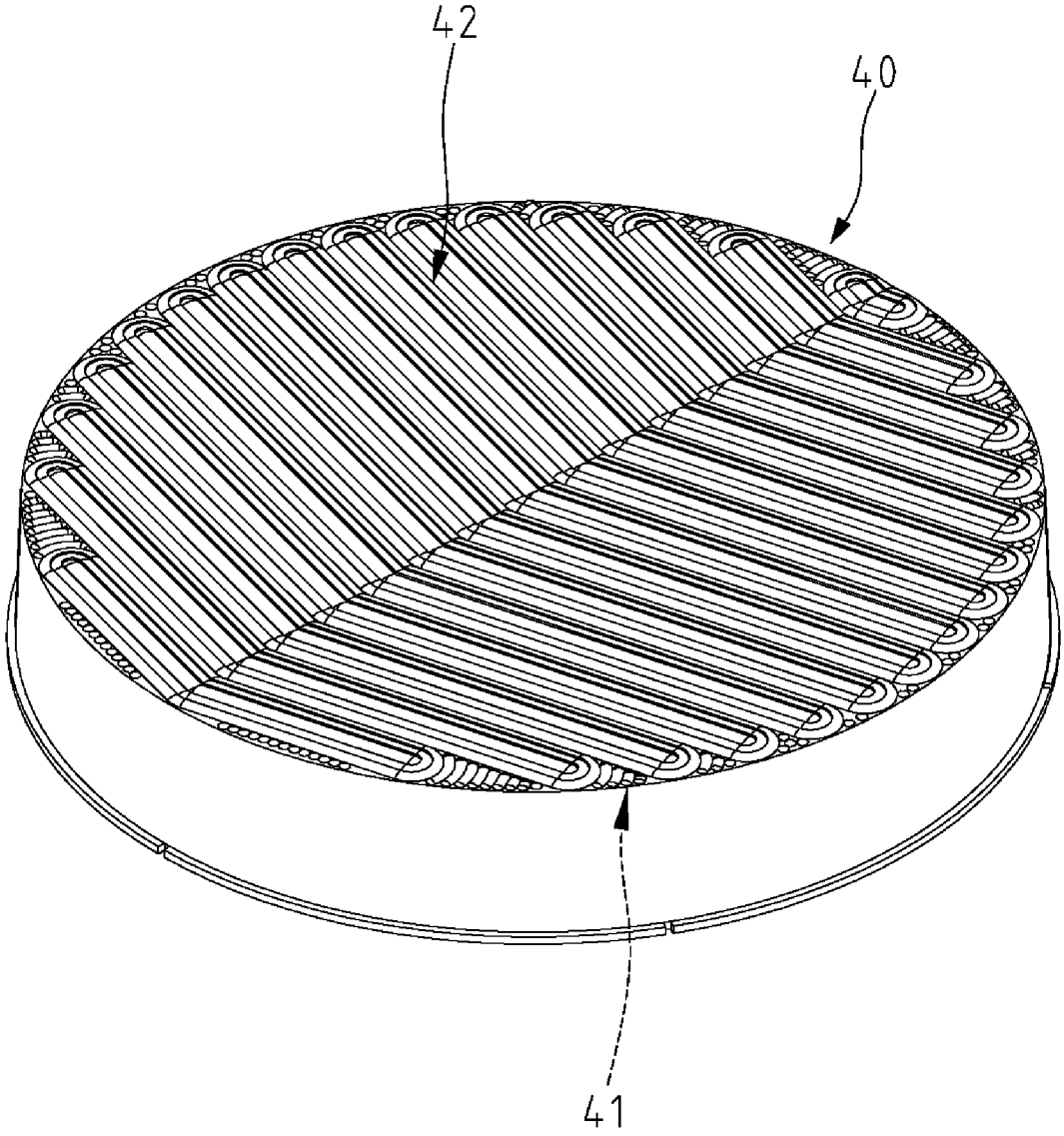
FIG. 7 is a schematic view showing the arrangement of the emergence surface of the inner cover.
Figure 8:
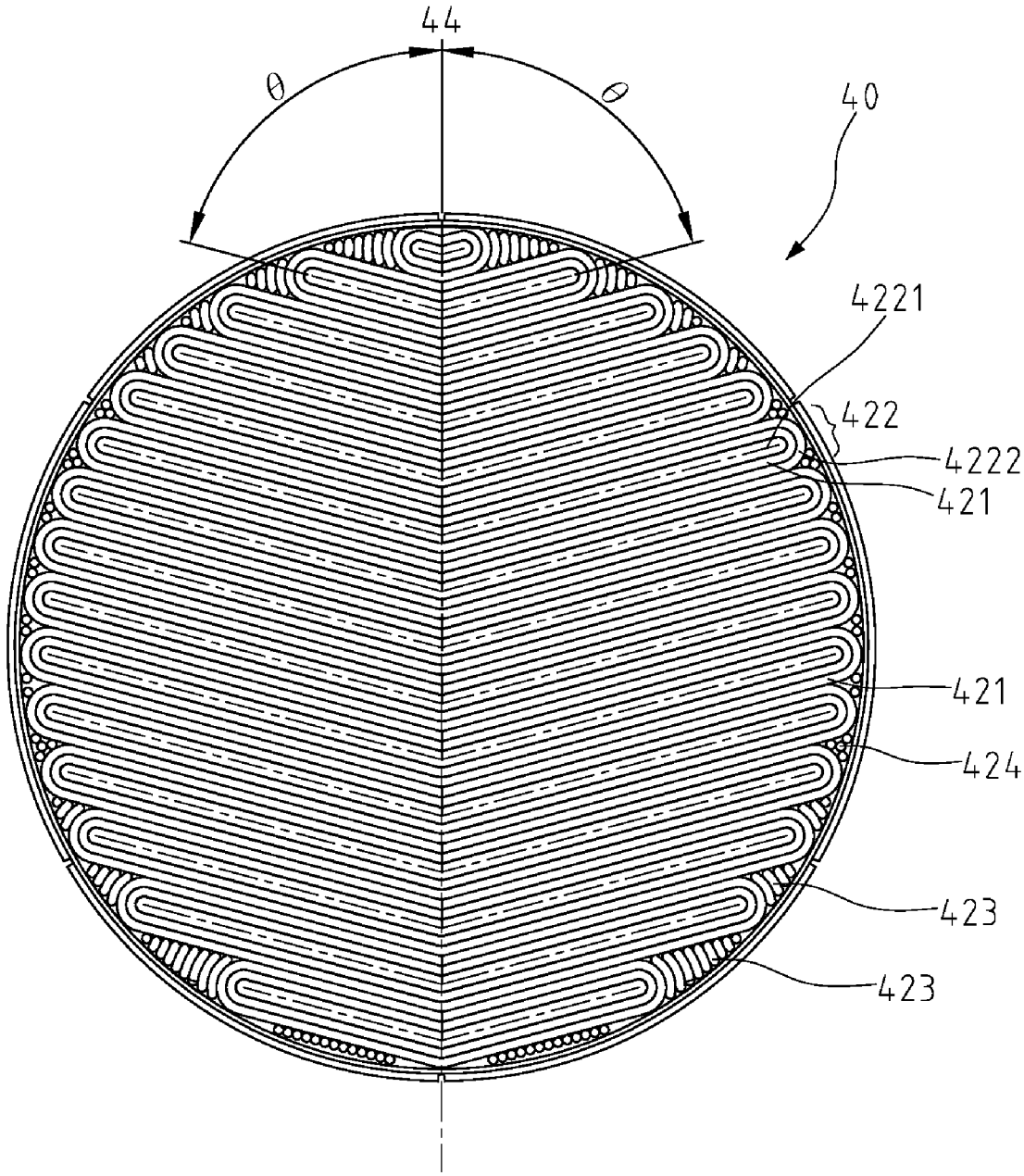
FIG. 8 is a top plan view showing the arrangement of the emergence surface of the front cover.
Figure 9:
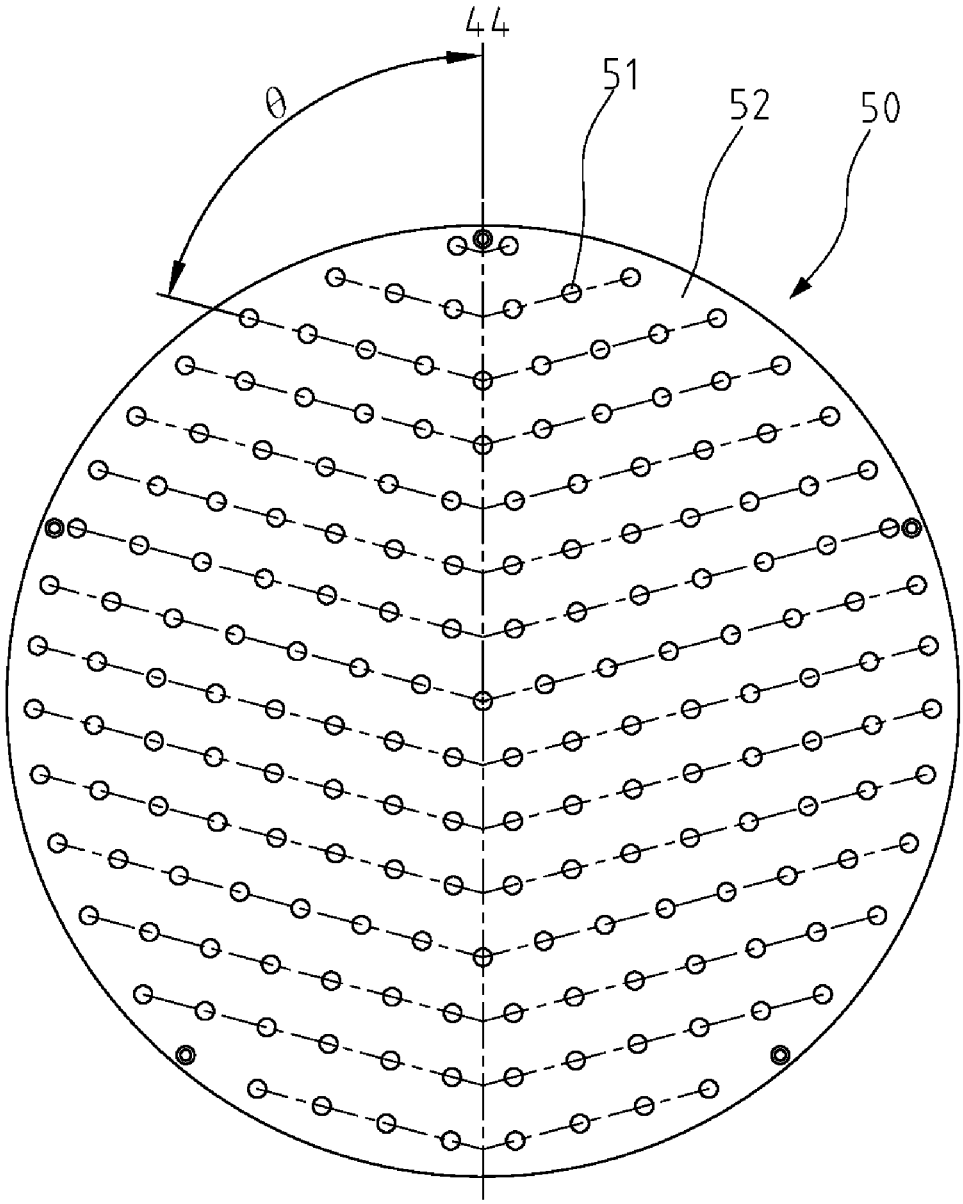
FIG. 9 is a schematic view showing the arrangement of the LEDs on the circuit board.

With reference to FIGS. 7 and 8, the second incidence surface 41 is a plan surface and may be formed as a concave lens or a convex lens. The second emergence surface 42 of the inner cover 40 has multiple columns 421 symmetrically arranged relative to a central axis 44 (the diameter) on the second emergence surface 42. That is, the columns 421 are divided into a left portion and a right portion (as shown FIG. 8). Either the left portion or the right portion is inclined to the central axis 44 for an angle θ. Due to the inclination of the columns 421, a substantially V shape is formed on the second emergence surface 42. It is noted that five columns 421 may be considered to form a column set 422 which has an arcuate portion 4222 formed on distal ends of the five columns 421. Each column set 422 has a central column 4221 located at a position corresponding to a position of arrangement of the LEDs 51. The number of the column set 422 is not limited to five. Other number may also be applied to form the column set 422 as long as the position of the central column 4221 corresponds to the position of the arrangement of the LEDs 51. Furthermore, pillars 423 and convex lenses 424 are applied to fill voids between the second emergence surface 42 and the column set 422 so as to ensure all light from the LEDs 51 are properly reflected.

Figure 10:
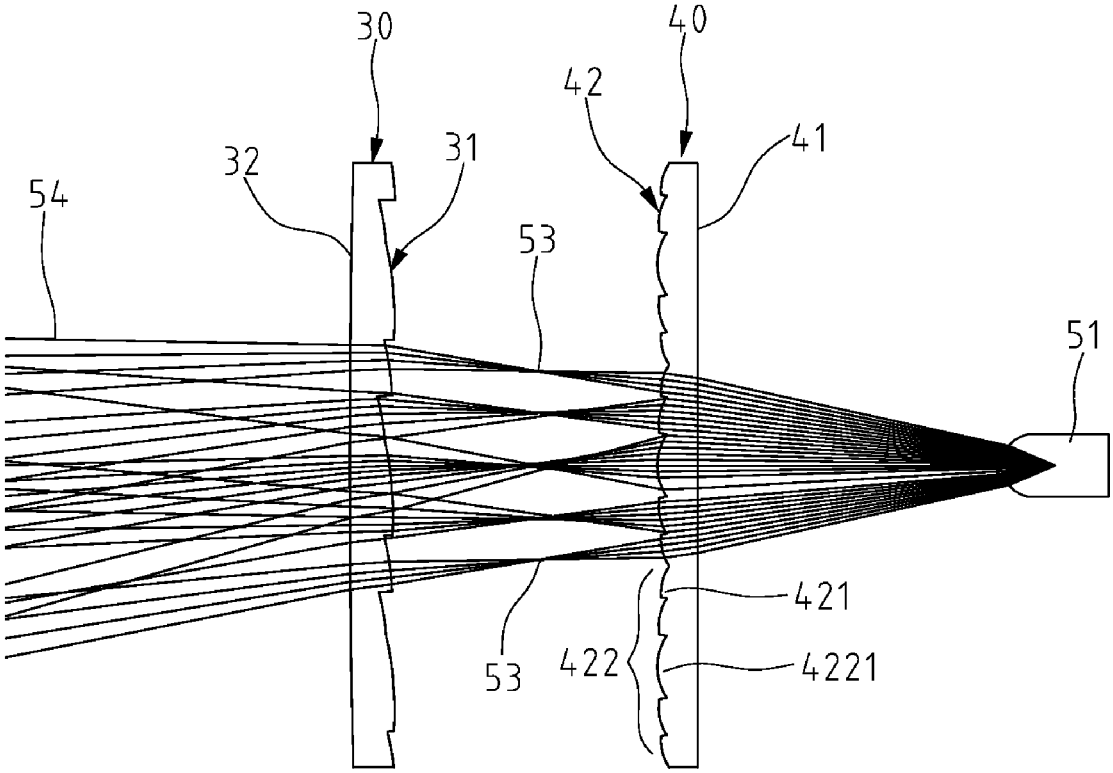
FIG. 10 is a schematic view showing the light path through the front cover and the inner cover.

With reference to FIG. 10, it is noted that the light from the LEDs 51 penetrates the second incidence surface 41 and leaves the second emergence surface 42 after being reflected by the column set 422. In this embodiment, each column set 422 includes five columns 421 such that the light from each LED 51 will be reflected respectively by each one of the five columns 421 such that five reflected light 53 are generated. In other word, the light is scattered so that the light is uniformed. Then after being reflected by the second emergence surface 42 of the inner cover 40, the light of the LEDs 51 enters the front cover 30 from the first incidence surface 31 and leaves the front cover 30 from the first emergence surface 32. The reflected light 54 is inclined downward relative to a vertical axis on the front cover 30 such that passersby are able to observe the reflected light 54.

Figure 11:
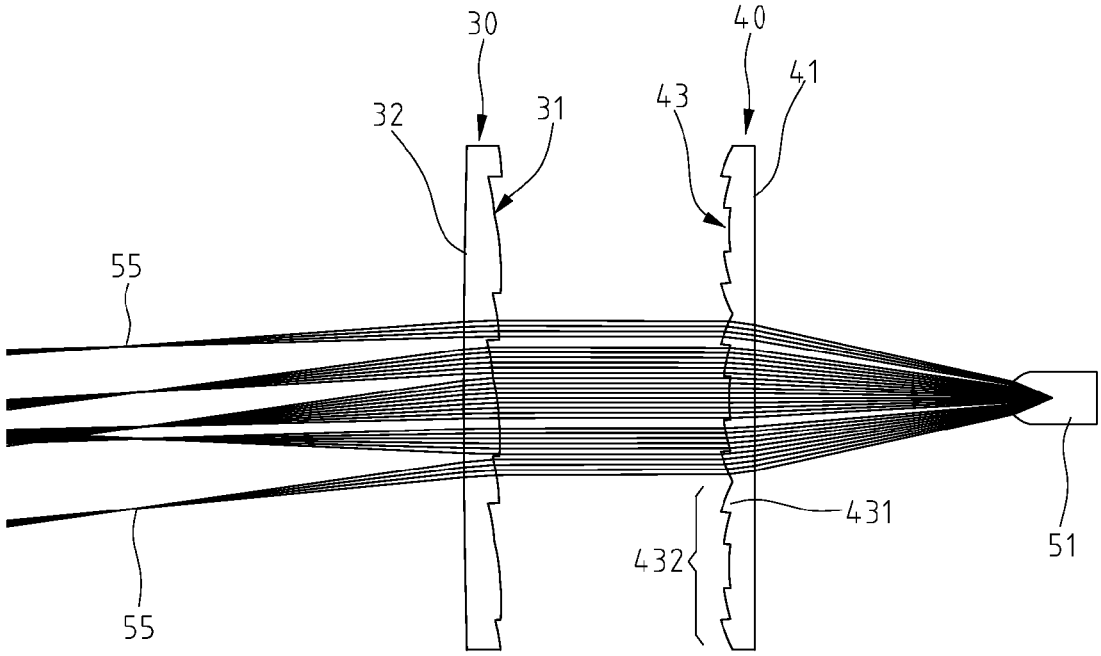
FIG. 11 is a schematic view showing the light path through the front cover and the inner cover of a different embodiment.

With reference to FIG. 11, if the curvature of the columns 421 is increased, the column set 422 on the second emergence surface 42 will generate reflected light beams 55 in front of the front cover 30, which also uniforms the light from the LEDs 51.

Figure 12:
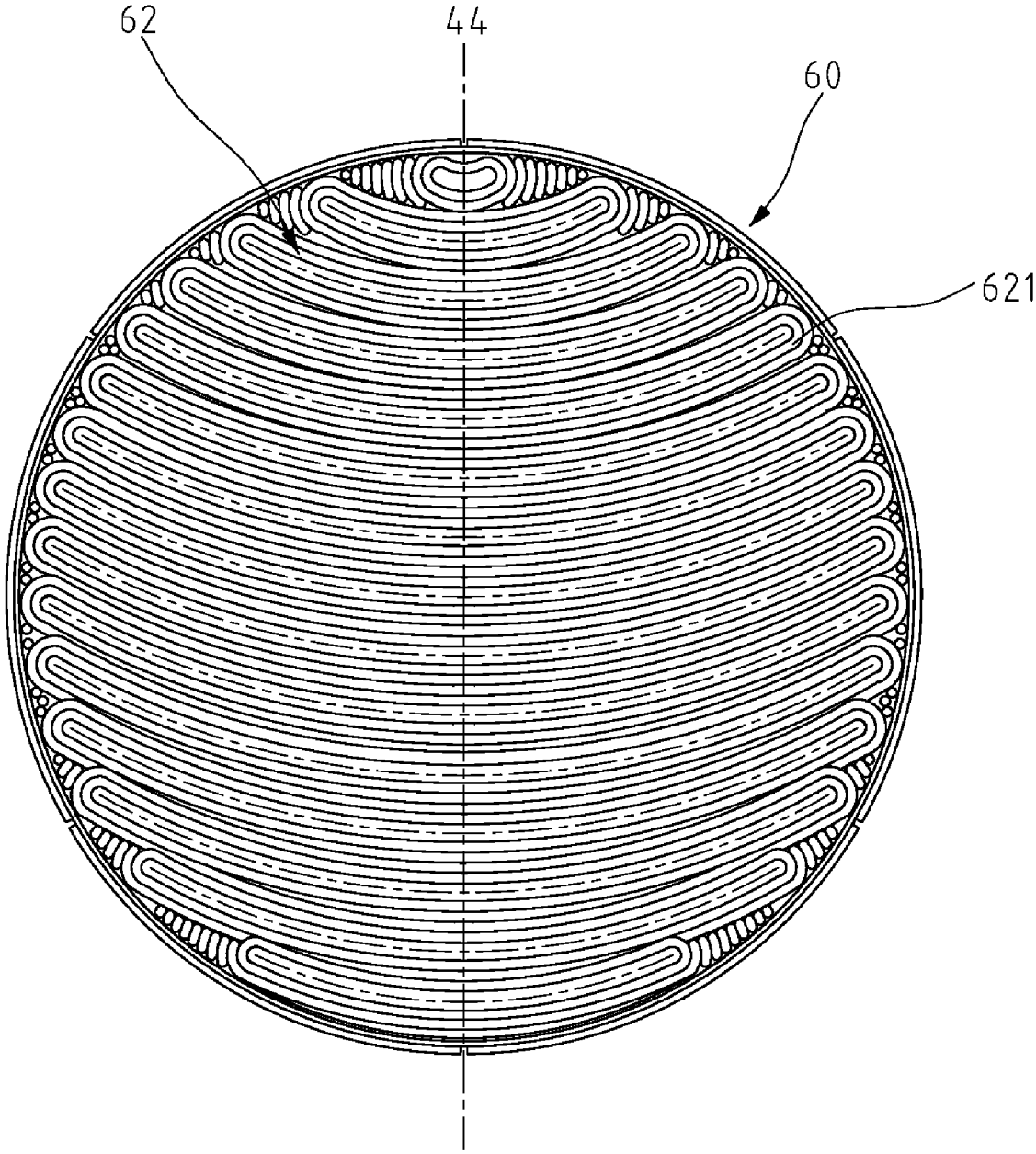
FIG. 12 is a top plan view showing a different arrangement of the columns on the emergence surface of the inner cover.
Figure 13A:
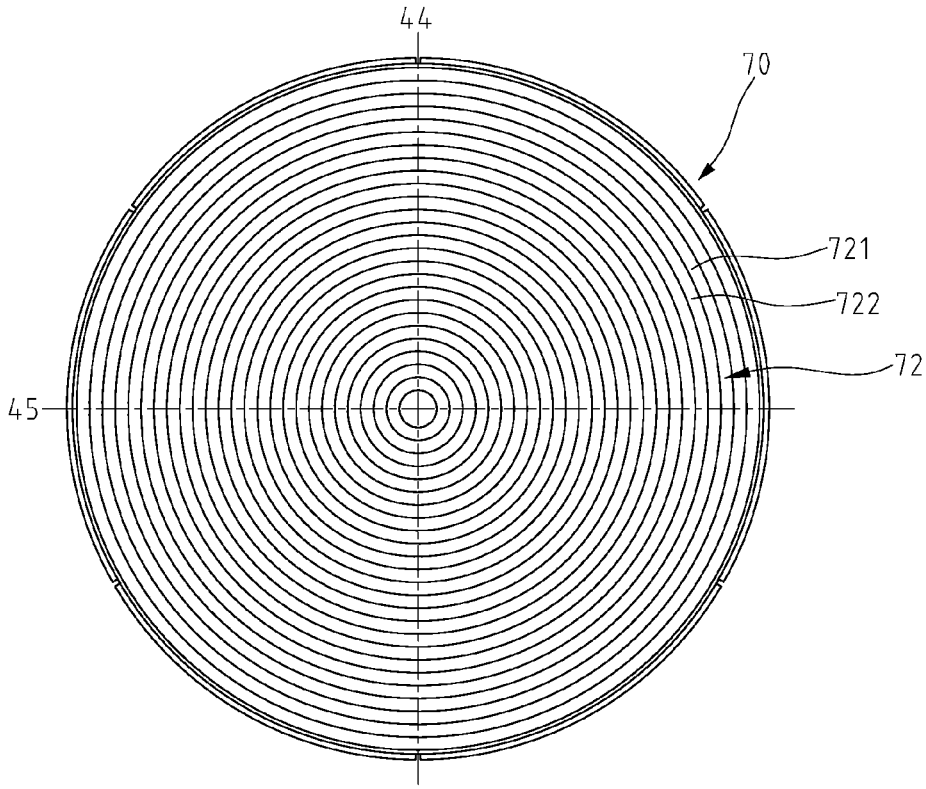
FIGS. 13A and 13B are schematic views showing yet a different embodiment of the present invention.
Figure 13B:
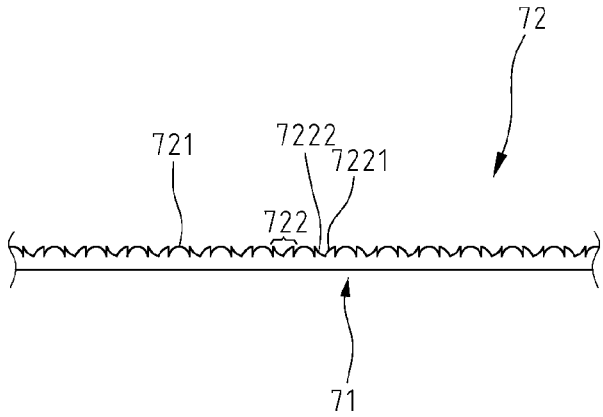

With reference to FIGS. 12, 13A and 13B, it is noted that the columns 621 are symmetrically arranged relative to the central axis 44 of the second emergence surface 62 so that a substantially U shape is formed by the columns 621. Furthermore, due to the symmetrical relationship of the columns 721 in FIGS. 13A and 13B, concentric circles are formed on the second emergence surface 72 of the inner cover 70. A circular recess 722 is formed between two adjacent concentric circles such that when the light from the LEDs 51 is reflected, the circular recess 722 is able to uniform the light. The circular recess 722 may also be divided into an arcuate convex surface 7221 and an arcuate concave surface 7222.

Figure 14:
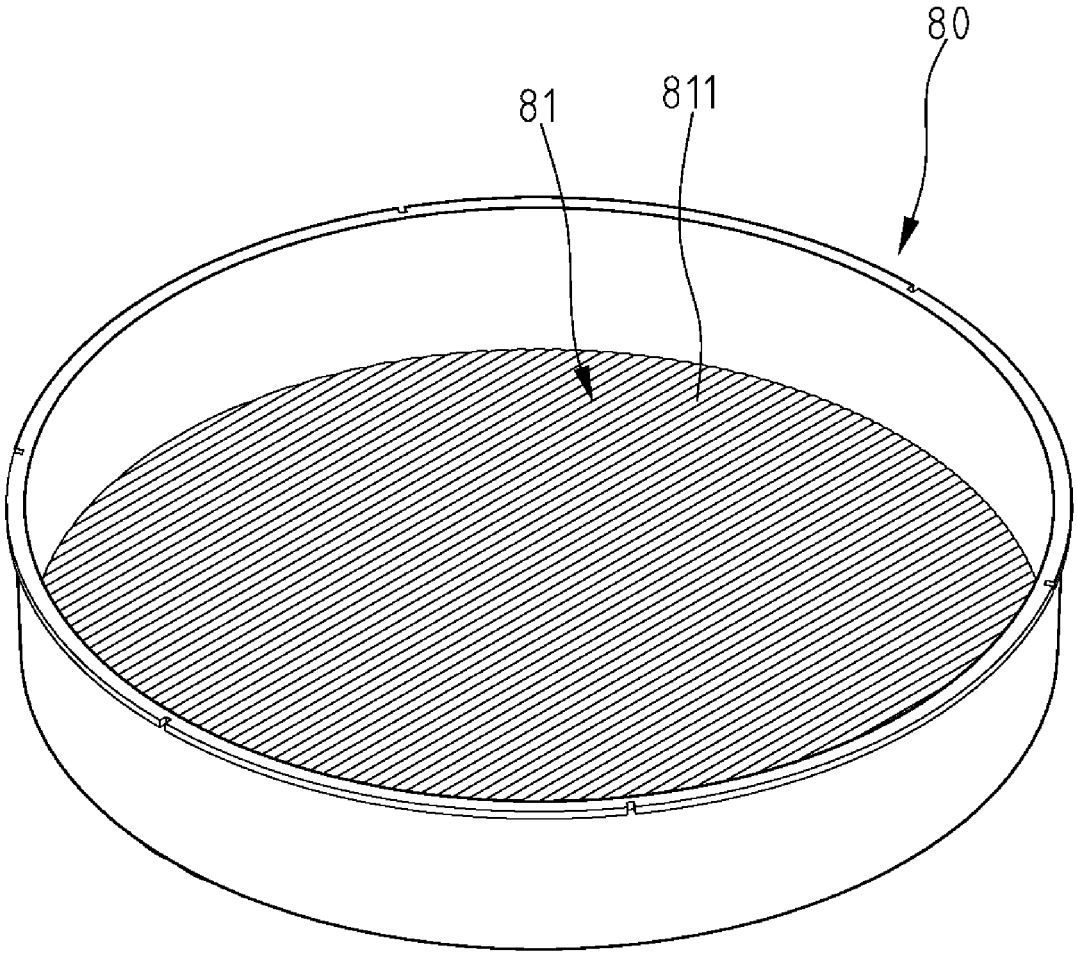
FIG. 14 is a perspective view showing the inner cover of the present invention.
Figure 15:
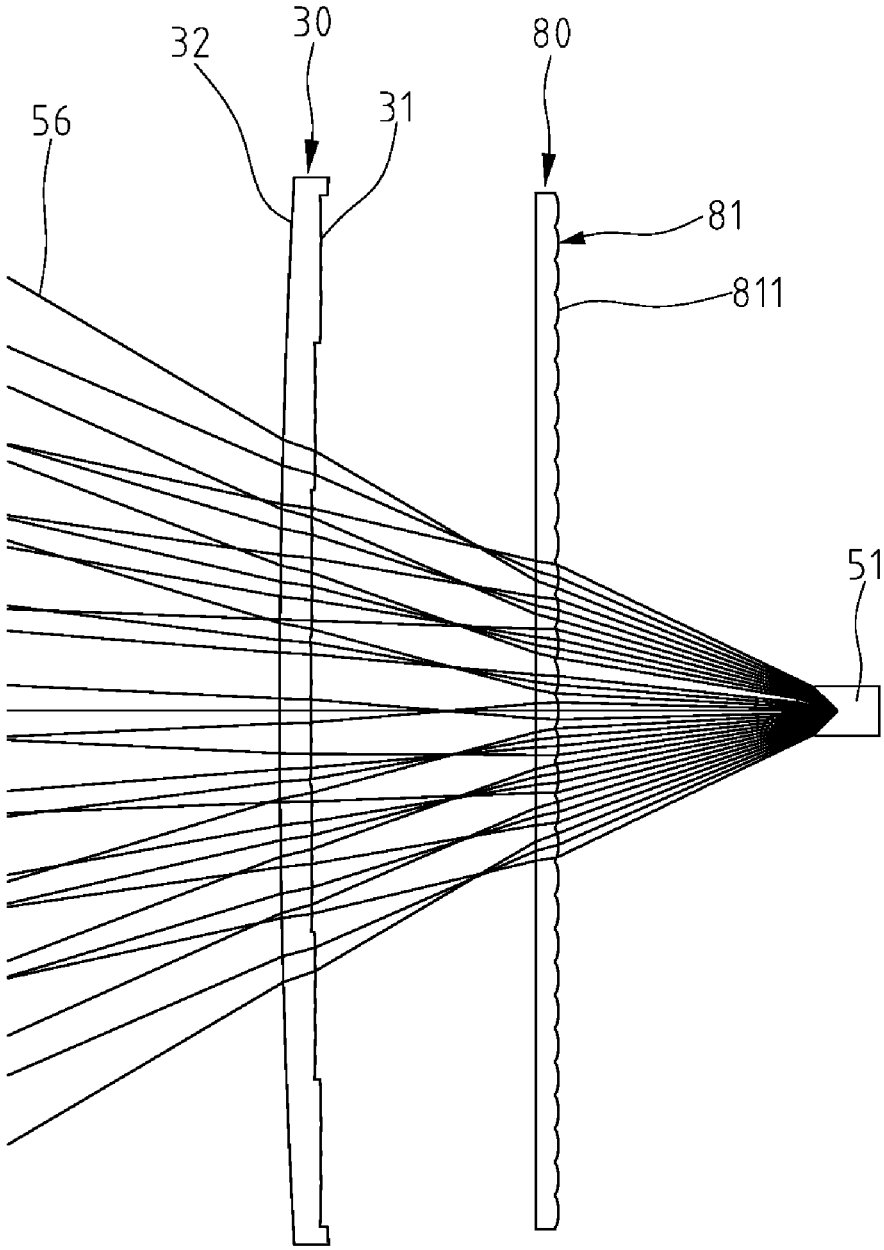
FIG. 15 is a schematic view showing the light path of the embodiment in FIG. 14.

With reference to FIG. 14, the second incidence surface 81 of the inner cover 80 may also be provided with multiple horizontally arranged columns 811 such that when the light from the LEDs 51, as shown in FIG. 15, passes through the second incidence surface 81 and reflected by the columns 811 as well as the front cover 30, the reflected light 56 is uniformed.

Figure 16:
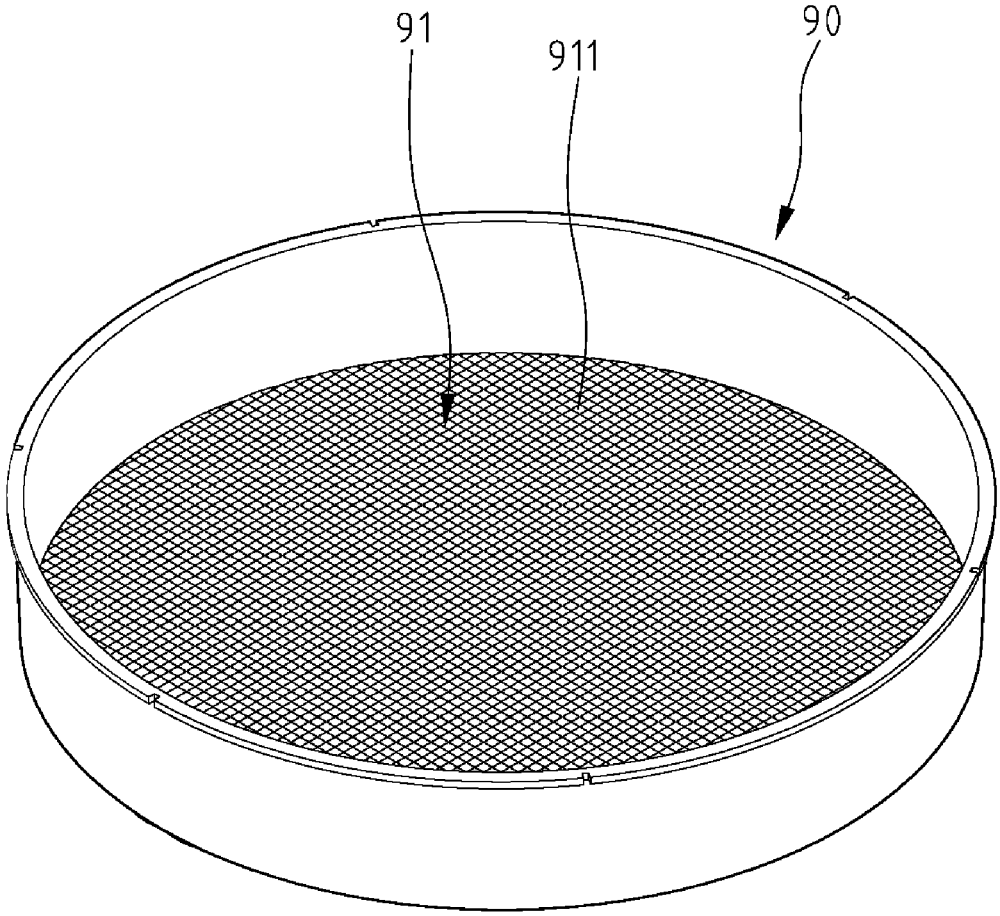
FIG. 16 is a perspective view showing the structure of the inner cover of a different embodiment of the present invention.

With reference to FIG. 16, multiple convex lenses 911 are provided on the second incidence surface 91 of the inner cover 90 so as to uniform the light from the LEDs 51.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A traffic light structure comprising:

an LED light source having a circuit board and multiple LEDs securely mounted on the circuit board;

a front cover having a first incidence surface provided with multiple lenses each with rectangular lens elements and a first emergence surface; and an inner cover sandwiched between the front cover and the LED light source and having a second incidence surface and a second emergence surface provided with column set symmetrically arranged relative to a central axis on the second emergence surface so that light of the LEDs scattered and reflected by the inner cover and the front cover is inclined downward to a horizontal axis of the front cover;

each of the column sets formed with five columns, an arcuate portion is formed on distal ends of each of the five columns and position of a central column in each of the column sets corresponds to position of arrangement of the LEDs; and pillars and convex lenses are provided to fill voids between the column sets and the second emergence surface.

2. The traffic light structure as claimed in claim 1, wherein the lenses of the front cover are hexagonal and are arranged as a beehive.

3. The traffic light structure as claimed in claim 2, wherein vertical curvature and horizontal curvature of each of the lenses of the front cover are the same.

4. The traffic light structure as claimed in claim 3, wherein vertical curvature and horizontal curvature of each of the rectangular lens elements are the same.

5. The traffic light structure as claimed in claim 2, wherein vertical curvature and horizontal curvature of each of the rectangular lens elements are the same.

6. The traffic light structure as claimed in claim 1, wherein vertical curvature and horizontal curvature of each of the rectangular lens elements are the same.

7. The traffic light structure as claimed in claim 1, wherein the columns are so arranged that a substantially U shape is formed.

8. The traffic light structure as claimed in claim 7, wherein the second incidence surface of the inner cover may be provided with multiple horizontally arranged columns such that when light from the LEDs passes through the second incidence surface and is reflected by the horizontally arranged columns as well as the front cover, the reflected light is uniformed.

9. The traffic light structure as claimed in claim 1, wherein the columns are so arranged that concentric circles are formed.

10. The traffic light structure as claimed in claim 9 further comprising a circular recess defined between two adjacent concentric circles.

11. The traffic light structure as claimed in claim 10, wherein the circular recess is composed of an arcuate convex surface and an arcuate concave surface.

12. The traffic light structure as claimed in claim 11, wherein the second incidence surface of the inner cover may be provided with multiple horizontally arranged columns such that when light from the LEDs passes through the second incidence surface and is reflected by the horizontally arranged columns as well as the front cover, the reflected light is uniformed.

13. The traffic light structure as claimed in claim 10, wherein the second incidence surface of the inner cover may be provided with multiple horizontally arranged columns such that when light from the LEDs passes through the second incidence surface and is reflected by the horizontally arranged columns as well as the front cover, the reflected light is uniformed.

14. The traffic light structure as claimed in claim 9, wherein the second incidence surface of the inner cover may be provided with multiple horizontally arranged columns such that when light from the LEDs passes through the second incidence surface and is reflected by the horizontally arranged columns as well as the front cover, the reflected light is uniformed.

15. The traffic light structure as claimed in claim 1, wherein the second incidence surface of the inner cover may be provided with multiple horizontally arranged columns such that when light from the LEDs passes through the second incidence surface and is reflected by the horizontally arranged columns as well as the front cover, the reflected light is uniformed.

* * * * *